United States Patent [19]

Santa Maria

[11] Patent Number: 4,568,304

[45] Date of Patent: Feb. 4, 1986

[54] CONVERTIBLE FIGURE DOLL

[76] Inventor: Ines Santa Maria, 111 Holland Rd., South Orange, N.J. 07079

[21] Appl. No.: 666,664

[22] Filed: Oct. 31, 1984

[51] Int. Cl.[4] ..... A63H 3/12; A63H 3/20

[52] U.S. Cl. ..... 446/321; 446/330

[58] Field of Search ..... 446/321, 330, 376, 378, 446/391, 394, 337, 338, 339, 340, 352

[56] References Cited

U.S. PATENT DOCUMENTS

| | | | |
|---|---|---|---|
| 1,148,540 | 8/1915 | Sancier | 446/321 |
| 1,766,008 | 6/1930 | Wilcox | 446/321 |
| 1,886,442 | 11/1932 | Wimmer | 446/338 |
| 2,195,127 | 3/1940 | Brucker | 446/321 |

FOREIGN PATENT DOCUMENTS

| | | | |
|---|---|---|---|
| 448937 | 9/1927 | Fed. Rep. of Germany | 446/321 |

*Primary Examiner*—F. Barry Shay

*Attorney, Agent, or Firm*—Natter & Natter

[57] ABSTRACT

A convertible figure doll includes two head configurations pivotally mounted and selectively positionable with respect to a body portion. The pivotal head displacement activates a gear arrangement for deploying an accessory member, such as a cape or a wing, attached to the body to provide a transformation in the appearance of the doll.

13 Claims, 4 Drawing Figures

CONVERTIBLE FIGURE DOLL

TECHNICAL FIELD

This invention relates generally to an amusement device, and especially to a doll having multiple configurations.

In particular, the device of this invention concerns a doll having a changeable head and a moveable subordinate body member.

BACKGROUND ART

Doll constructions that incorporate changeable features conventionally utilized individual doll figures joined at a common waist. A skirt or similar article of clothing selectively covered one of the doll figures, such as typically shown in U.S. Pat. No. 4,107,873.

Those reversible dolls did not effectively transform the body configuration aside from changing the face and clothing. Also, those dolls were not commonly mounted for pivotal motion about an axis.

Previous changeable dolls, mounted for rotatable movement to present alternate embodiments, were disclosed in U.S. Pat. Nos. 1,148,540, 2,662,339 and 4,136,483. The pivotal head movement of those various devices however did not co-act with pendant body members for altering the body boundary configuration.

DISCLOSURE OF THE INVENTION

The nature of this invention involves a convertible doll having a head which appears in conjunction with a complimentary body portion. The format of the doll can be readily changed by substituting a different or contrasting head portion. The conversion of the doll's appearance also includes the accompanying deployment of a body attached appendage.

The structure of the doll includes a body portion having a cavity for concealing an alternate head mounted to opposite ends of a neck supported on an axle. The sides of the body portion have an opening providing access to the body cavity and clearance for the neck member and head portion during pivotal movement in a plane parallel to a plane coincident with the front elevational view of the doll.

A feature of this invention is that the axle is journaled for rotation within the cavity and adapted to operate a gear arrangement. The gear, in turn, drives a spool positioned within the body portion. The spool retracts and/or releases a plurality of drawstrings for displacing an auxiliary element in cooperation with the corresponding head displayed.

Having thus summarized the invention, it will be seen that it is an object thereof to provide a convertible figure doll of the general character described herein.

Another object of this invention is to provide a convertible figure doll having transformation of both head and body features.

A further object of this invention is to provide a convertible figure doll wherein the head movement is coordinated with the deployment of supplemental body components.

Still another object of this invention is to provide a convertible figure doll which is simple in construction, reliable in use, and well adapted for mass production fabrication techniques.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention.

BEST MODE FOR CARRYING OUT THE INVENTION

Figure 1:
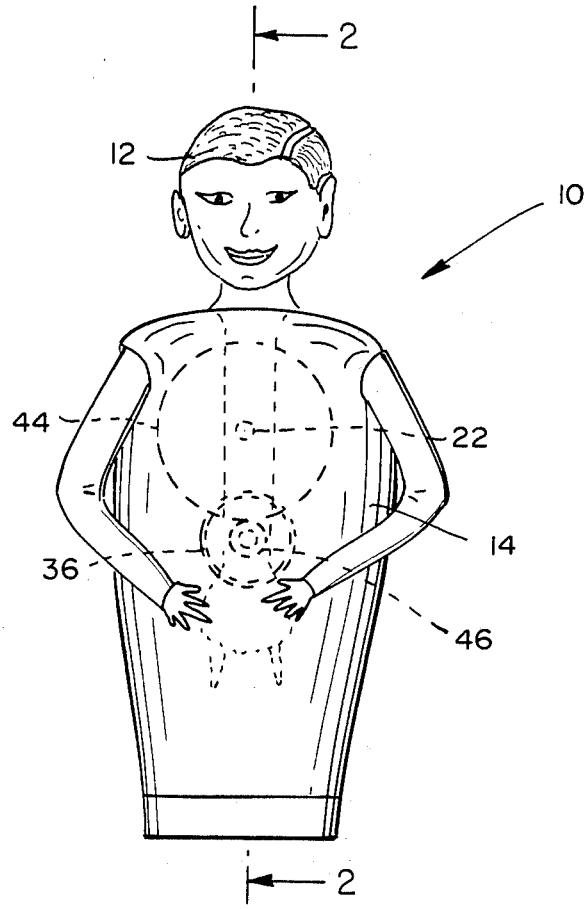
FIG. 1 is a front elevational view showing a convertible figure doll of this invention illustrating, in broken line, an alternate head construction as concealed within a body cavity and a gear arrangement for turning a spool.

Referring now in detail to the invention, the reference numeral 10 denotes generally a convertible figure doll in accordance with this invention.

The convertible figure doll 10 is typically illustrated in FIG. 1 and, for the purpose of this exemplary embodiment, is described with two alternate head configurations. A head member 12 is provided with appropriate facial features for representing a child's face. A body portion 14 includes representative arm and hand structure and may contain appurtenant clothing. The body portion 14 is intended to be self-supporting and, for this purpose, is provided with a pedestal base.

Figure 2:
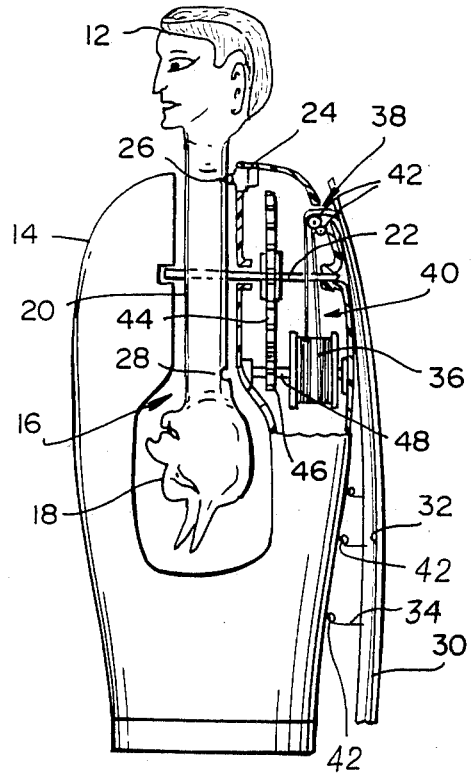
FIG. 2 is a sectional view taken along line 2—2 of FIG. 1 showing two head members mounted to a rotatable axle which actuates the gear arrangement.

Referring now to FIG. 2, it will be seen that a cavity 16 is formed within the body portion 14 and that an alternate head member 18 can be concealed within the cavity 16. The alternate head member 18 is preferably provided with contrasting facial features and, for example, is shown as having a sinister appearance as in the Dracula character. The head members 12, 18 are connected by a neck extension 20 which is supported on an axle 22. The axle 22 is journaled at its opposite ends as shown in FIG. 2 and is rotatable during pivotal movement of the head members 12, 18.

In order to stabilize the head members 12, 18 in either of the selected positions, a resilient projection element 24, such as a socket mounted spring urged ball, is provided along an upper margin of the cavity 16. A detent 26, 28 or similar recess is provided along the neck extension 20 and is alignable with the resilient projection 24 for providing relesable securement.

It should also be noted that the cavity 16 defines a passageway for the head members 12, 18 and the neck extension 20 during pivotal movement in a plane substantially parallel to a plane passing through the front elevational view of FIG. 1.

Figure 3:
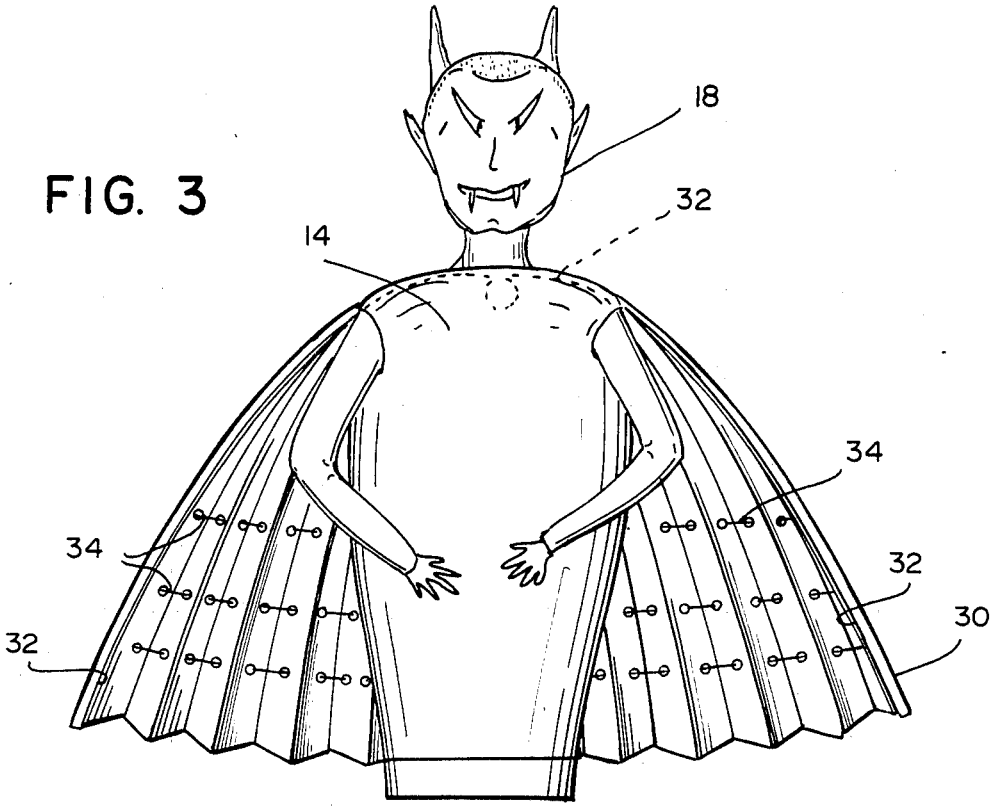
FIG. 3 is a front elevational view showing the alternate head configuration and the deployment of a pendant body member.

The auxiliary body configuration in conjunction with the changeable heads will now be described. The transformation of the figure doll 10 from FIG. 1 to FIG. 3 includes the registration of the alternate head member 18 with the body 14 and the simultaneous deployment of an accessory member, such as a cape 30. The cape 30 is preferably constructed of a pliable material which has been pleated and joined to the body portion 14 at a location behind the neck extension 20. A wire spring 32 is utilized for urging the cape into a normally open position, as shown in FIG. 3.

A plurality of drawstrings 34, such as nylon filaments, are secured at their respective ends to the periphery of the cape 30 and are adapted for pulling the cape into a retracted position behind the body portion 14 when the head member 18 is rotated into registration with the body portion 14. This is accomplished by use of a wind-up spool 36. A series of guide pulleys 42 direct the drawstrings 34 through an aperture 38 and to the spool 36. A rear compartment 40 in the body portion 14 houses a gear arrangement which includes a gear member 44, such as a bevel gear, adopted for rotation with the axle 22. The gear member 44 meshes with a complimentary gear member 46 affixed to a spool shaft 48. In operation, the head 12 is selectively rotated approximately 90° by disengaging the projection 24 from within the detent 26. The alternate head 18 is positioned immediately above the body 14 and secured in place by the projection 24 within detent 28. During rotation of the heads 12, 18, the axle 22 displaces the gears 44, 46 and shaft 48 turning the spool 36. The drawstrings 34, in this instance, will be released against the force of the spring 32 to unfurl the cape 30. It should thus be apparent that by use of appropriate gear ratios, the linear displacement of the drawstrings 34 will be effective for retracting or protracting the cape 30. In like manner, rotation for registration of the head 12 will wind the drawstrings 34 around the spool 36 and will pull the cape 30 to a closed position, as shown in FIG. 1.

Figure 4:
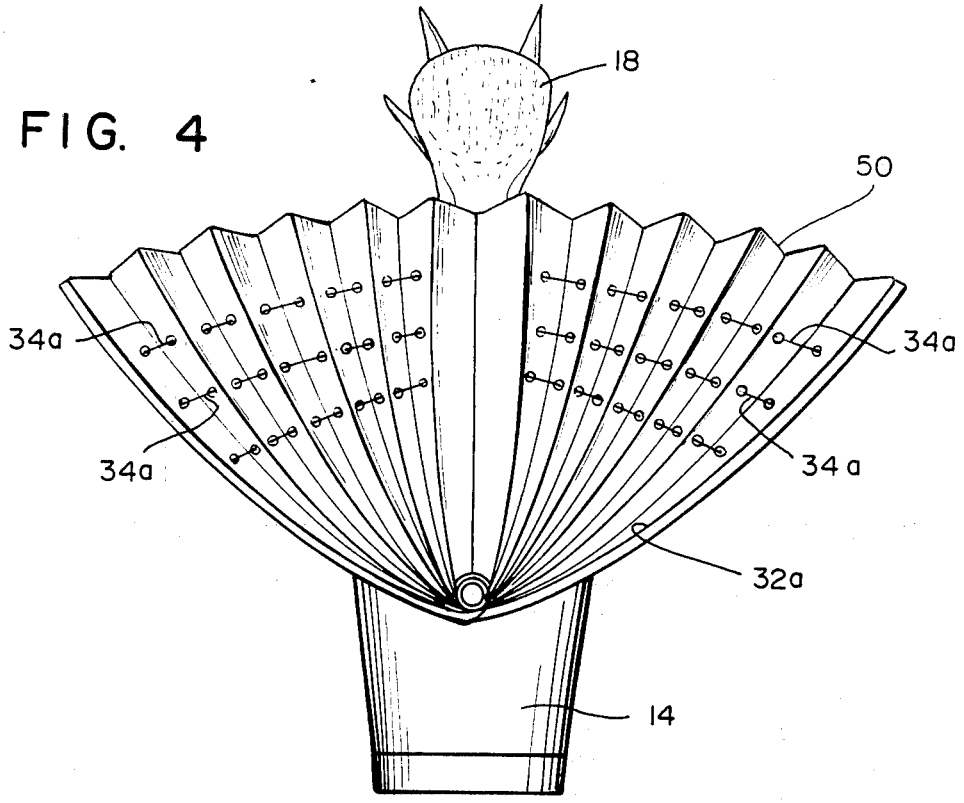
FIG. 4 is a rear elevational view of a variant embodiment showing another pendant body member.

In an alternate embodiment, shown in FIG. 4, a wing member 50 has been substituted in place of the cape 30. The construction and operation is substantially the same as described with reference to the previous embodiment. The variant embodiment similarly utilizes a wire spring 32*a* and a plurality of drawstrings 34*a* for wind-up about a gear-driven spool.

In view of the following, it should be seen that there is provided a convertible figure doll which achieves the various objects of this invention and which is well adapted to meet conditions of practical use.

Since various possible embodiments might be made of the present invention or modification might be made of the exemplary embodiments set forth, it is to be understood that all of the materials shown and described in the accompanying drawings are to be interpreted as illustrative and not in a limiting sense.

Having thus described the invention, there is claimed as new and desired to be secured by Letters Patent:

1. A convertible figure doll having multiple head and body configurations comprising a body portion, said body portion defining a cavity therein, a plurality of head members, at least one of said head members being concealable within the cavity, axle means mounted within said cavity for pivotally supporting each of said head members with respect to the body portion, said head members being adapted for the selective registration of one of said head members with the body portion and for the concurrent concealment of another of said head members within the cavity, at least one accessory member connected to the body portion, said accessory member being extendable from a retracted to a protracted mode, deployment means for displacing the accessory member from one to the other of said modes, and mechanical means for transmitting rotational motion of the axle means as it is generated by the pivotal movement of the head member to activate the deployment means.

2. A convertible figure doll as claimed in claim 1 wherein the axle means includes an axle journalled for rotation within said cavity, a neck extension mounted to said axle, and said head members being secured to the neck extension.

3. A convertible figure doll as claimed in claim 2 further including a transverse passageway through the body portion, said transverse passageway being in communication with the cavity and adapted for accommodating the neck extension and the head members during rotational displacement.

4. A convertible figure doll as claimed in claim 3 including two head members, each of said members being mounted at opposite ends of the neck extension with one of said head members being adapted for concealment within the cavity when the other of said head members is in registration with the body portion.

5. A convertible figure doll as claimed in claim 4 wherein the deployment means includes a plurality of drawstrings and spool means within said cavity for windably receiving said drawstrings.

6. A convertible figure doll as claimed in claim 5 wherein the mechanical means includes gear means mounted on the axle for transmitting rotational motion to the spool means as it is generated by the pivotal head movement.

7. A convertible figure doll as claimed in claim 6 including a spool member, a toothed gear rotatable with the spool member, said toothed gear adapted for meshing engagement with a complementary gear member mounted on the axle.

8. A convertible figure doll as claimed in claim 6 further including a spring element for urging the accessory member to the protracted mode.

9. A convertible figure doll as claimed in claim 6 wherein the guide means includes access apertures provided in the body portion and pulley members for directing the filament members to the spool.

10. A convertible figure doll as claimed in claim 6 wherein the accessory member is in the form of expandible wing members.

11. A convertible figure doll as claimed in claim 6 wherein the accessory member is in the form of a spreadable cape member.

12. A convertible figure doll as claimed in claim 5 wherein the drawstrings include a plurality of filaments, one end of each filament being affixed to the spool means, the other end of each filament being secured at respective locations along a periphery of the accessory member further including guide means for directing the filaments to the spool means.

13. A convertible figure doll having multiple head and body configurations comprising a body portion, a plurality of head members, means mounting each of said head members in pivotally rotatable relation with respect to the body portion for selective registration with the body portion to represent a plurality of figures, said body portion further including at least one accessory member connected to said doll, said accessory member having means adapting it for transitional displacement of parts thereof from a condition wherein it is in a retracted mode to a condition wherein it is in a protracted mode, mechanical means on said doll linking the means pivotally mounting said heads with means for displacement of the accessory member for coordinating said head registration and a corresponding displacement of the accessory member to provide a transformation in the appearance of the doll wherein the accessory member means include an extendible body attachment, said body attachment being normally urged into a protracted mode, drawstring means for retracting the body attachment, said means mounting said head members including an axle, said mechanical means including a spool for windably receiving the drawstring means, and gear means mounted on the axle for transmitting rotational motion of said axle to the spool as it is generated by pivotal head movement.

* * * * *